US005811941A

United States Patent [19]

Barton

[11] Patent Number: 5,811,941

[45] Date of Patent: Sep. 22, 1998

[54] HIGH FREQUENCY ELECTRONIC BALLAST FOR A HIGH INTENSITY DISCHARGE LAMP

[76] Inventor: Bina M. Barton, 17812 Jamestown La., Huntington Beach, Calif. 92647

[21] Appl. No.: 810,479

[22] Filed: Mar. 1, 1997

[51] Int. Cl.[6] ..... H05B 37/02

[52] U.S. Cl. ..... 315/307; 315/247; 315/308

[58] Field of Search ..... 315/307, 308, 315/247, 309

[56] References Cited

U.S. PATENT DOCUMENTS 4,910,440 3/1990 McMullin ..... 315/307

5,111,118 5/1992 Fellows et al. ..... 315/308 X 5,381,076 1/1995 Nerone ..... 315/308 X

*Primary Examiner*—Benny Lee

*Assistant Examiner*—Justin P. Bettendorf

*Attorney, Agent, or Firm*—Monty Koslover

[57] ABSTRACT

A lamp power electronic ballast circuit, which can be packaged in a small, compact module and is designed for starting and energizing a high intensity discharge lamp with high frequency power. The ballast circuit contains provision for correction of the source input power factor to near unity, greatly reducing ballast losses associated with input power factor, and includes a unique starter circuit using a transformer small in size and low in losses, and producing a pulse of at least 6000 volts with current sufficient to start a metal-halide high intensity discharge lamp.

2 Claims, 5 Drawing Sheets

HIGH FREQUENCY ELECTRONIC BALLAST FOR A HIGH INTENSITY DISCHARGE LAMP

BACKGROUND OF THE INVENTION

1. Field of the Invention

The invention relates to electrical ballasts used to start and energize high intensity discharge lamps.

2. Background

Industry has produced a number of types of high intensity discharge lamps. These include high pressure sodium lamps and mercury-vapor lamps such as are often used in outdoor lighting. Many of these lamps require ballasts to start and energize them, and the ballasts are therefore a necessary part of the lighting installation.

A new high intensity discharge lamp, having considerable advantages in use in display illumination, has recently become available. This lamp is a metal-halide lamp that produces illumination several times greater than most lamps having the same input power. For example, a 39 watt metal-halide lamp will output illumination the equivalent of a 150 watt floodlight. There are many applications for the use of these low power, high illumination lamps, the lamps being particularly useful in illumination of displays needing a great amount of light but with little radiated heat.

There are no known high frequency ballasts available which are suited for use with metal-halide lamps. Some present ballasts may be adaptable. However, they are large and dissipate much heat, making them unsuitable for applications where the lamps (and ballasts) are to be placed near or above the display.

There is therefore a need for a ballast which is small in size and dissipates relatively little heat, and is designed to operate metal-halide lamps efficiently.

SUMMARY OF THE INVENTION

The present invention provides a high frequency electronic ballast packaged in a small module and producing a high voltage, high frequency supply for connection to a high intensity discharge lamp such as a metal-halide lamp. The ballast circuit receives 50 Hz or 60 Hz input power, corrects the input power factor to near unity, converts the AC input to a high voltage AC, 44 kHz output, and also applies a high voltage starting pulse to the lamp. The power circuit is efficient and dissipates relatively little power. The ballast module is light, weighing typically less than a third the weight of conventional ballasts it replaces.

Accordingly, it is a principal object of this invention to provide an electronic ballast for high intensity discharge lamps that is light in weight and has low heat dissipation.

Another object is to provide an electronic ballast that is small in size and can be placed near the lamp it is supplying.

Further objects and advantages of the invention will be apparent from studying the following portion of the specification, the claims and the attached drawings.

DESCRIPTION OF THE PREFERRED EMBODIMENT

Figure 1:
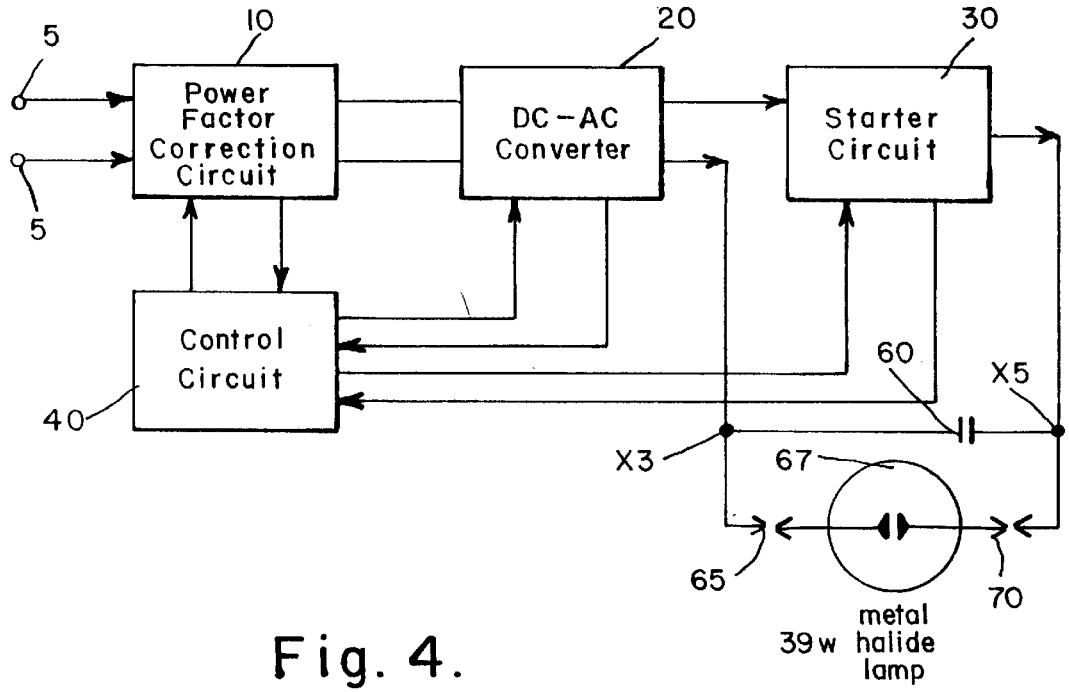
FIG. 1 is a block diagram of a ballast circuit according to the present invention.

Referring particularly to the drawings, there is shown in FIG. 1 a block diagram of the electronic ballast circuit according to the principles of the present invention. 50 or 60 Hz, 120 or 277 VAC power is input at the ballast input terminals 5 and is rectified and conditioned by a power factor correction circuit 10. The rectified power, which is 150 VDC or 325 VDC depending on the input voltage, is then passed to a DC-AC converter circuit 20 which produces a high frequency (44 KHz) AC output and a DC output. The DC output signal is connected to a starter circuit 30 that supplies a starting pulse of 6000 V for a connected lamp 67 as well as a ballasting impedance. The AC 44 KHz signal from the DC-AC circuit 20 is connected to one terminal 65 of the lamp 67 connector, while the starter circuit 30 output signal is connected to the other lamp 67 connector terminal 70. A capacitor 60 is connected as a filter across the output lines at points X3 and X5 before the lamp connector terminals.

A control circuit 40 provides switching control signals, temperature monitoring and shutdown protection signals to each of the above mentioned circuits.

The entire ballast circuit is packaged in a small module. A ballast for a 39 W metal-halide lamp would be sized approximately 1¼ in. high by 4 in. wide by 6 in. long and weigh approximately 8 ounces. This is much lighter than a conventionally made ballast which could weigh two pounds or more. The ballast efficiency is also high because of the high frequency switching and DC voltage operation. Ballast heat dissipation is thus expected to be relatively low, although because of its compact arrangement the ballast inside temperatures may reach 60 deg. C. All components used in the circuit are rated to withstand temperatures to 90 deg. C. or above, so that reliability is not compromised.

Figure 2:
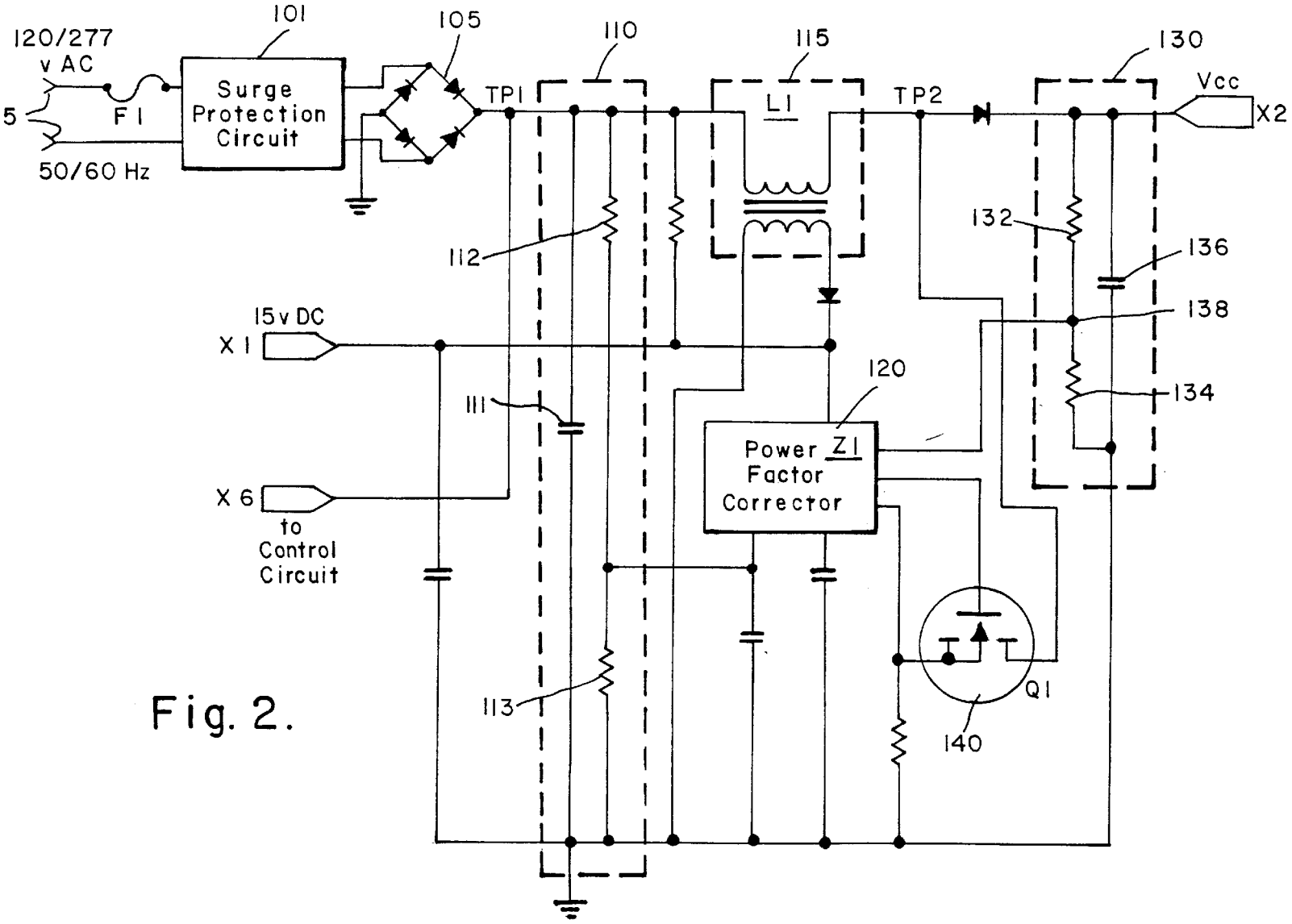
FIG. 2 is a simplified schematic of the power factor circuit forming part of the ballast circuit in FIG. 1.

The circuits comprising the ballast circuit shown in FIG. 1 are now discussed. Refer to FIG. 2. This is a simplified schematic diagram of the power factor correction (PFC) circuit 10 which operates as a power conditioner, rectifying and conditioning the input AC power for use by the remaining circuits of FIG. 1.

The PFC circuit uses a surge protection circuit 101, a full-wave bridge rectifier 105, a DC input filter circuit 110, a choke L1, 115, a PFC integrated circuit Z1, 120, a MOSFET transistor Q1, 140, an output filter and feedback circuit 130, and a number of resistors, capacitors and diodes to convert the line input voltage of 120 VAC or 277 VAC to a DC voltage with an input power factor of greater than 0.9.

Figure 6:
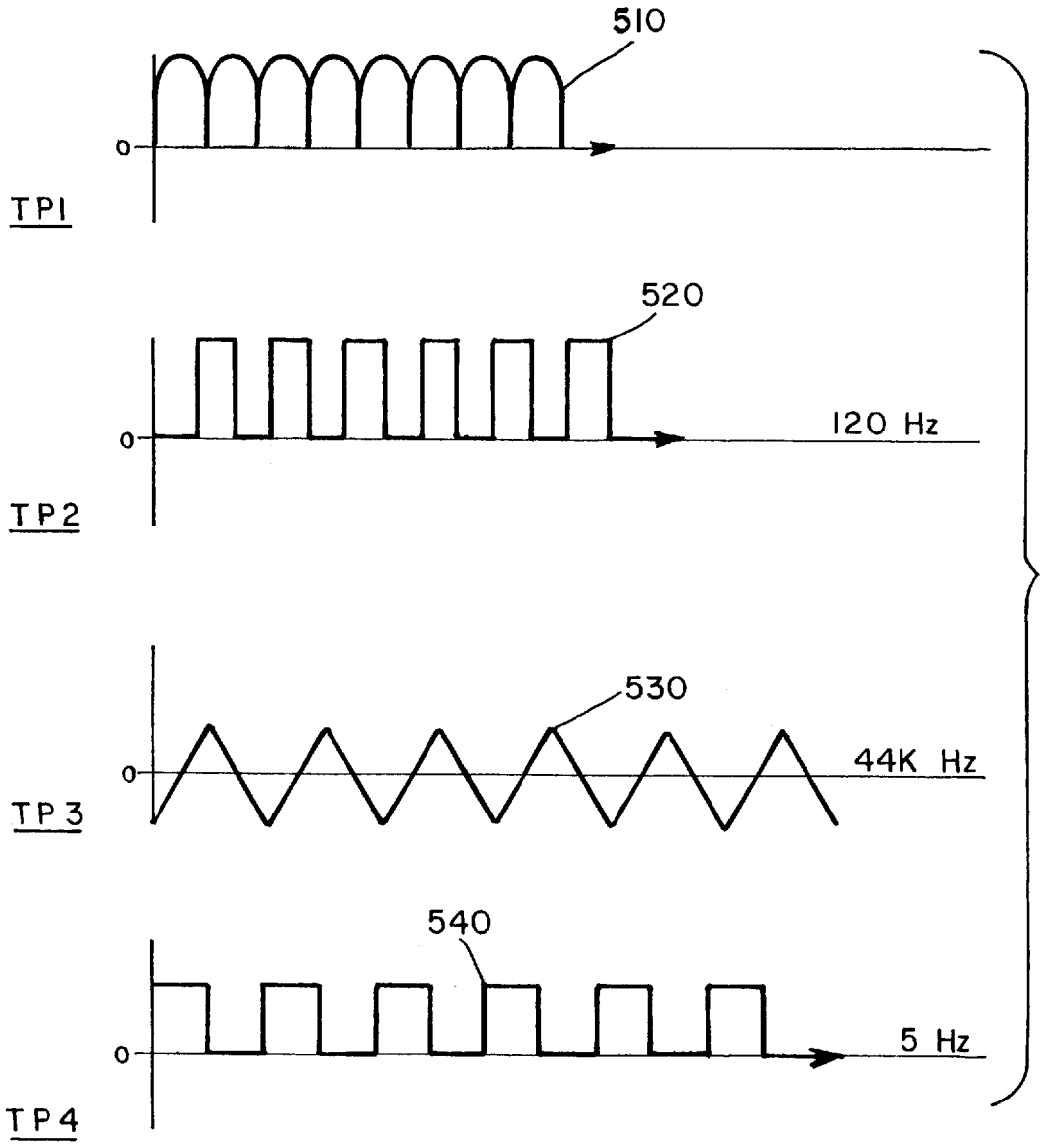
FIG. 6 illustrates the voltage waveforms at various test points in the ballast circuit, and useful in understanding operation of the device.

Input AC power is connected to the input terminals 5, fused by fuse F1 and through a surge protection means 101, then to a full-wave bridge rectifier 105. The bridge rectifier 105 outputs a ripple DC voltage at Test point 1 (TP1) which is illustrated in FIG. 6, TP1. An input filter means comprising a capacitor 111 paralleled with a first resistor 112 and series second resistor 113, acts to filter and smooth the DC ripples. The bridge rectifier 105 output is also connected to the control circuit at X6 to provide power for a 12 VDC power supply.

The filtered DC bus which is at 150 VDC or 325 VDC, depending on the input AC voltage, is connected to a choke L1, 115 which acts together with a MOSFET transistor Q1, 140 driven by a PFC IC Z1, 120 and input capacitors, to increase the input power factor to near unity. This is an industry standard technique explained in several catalogs.

The MOSFET Q1 outputs a 120 Hz pulsed waveform at TP2 which is illustrated in FIG. 6, TP2. The power factor corrector IC Z1, 120 receives feedback signals from a center tap 138 between a fourth resistor 132 and fifth resistor 134 that together with a third capacitor 136, form an output filter 130 for harmonic correction. The filter output DC voltage is noted as Vcc and is connected at terminal X2 to the DC-AC circuit 20. If an over-temperature or over-current condition is sensed, the control circuit 40 will initiate a shutdown signal to the PFC circuit. This is done through connector X1 which connects the control circuit to the PFC chip Z1.

Figure 3:
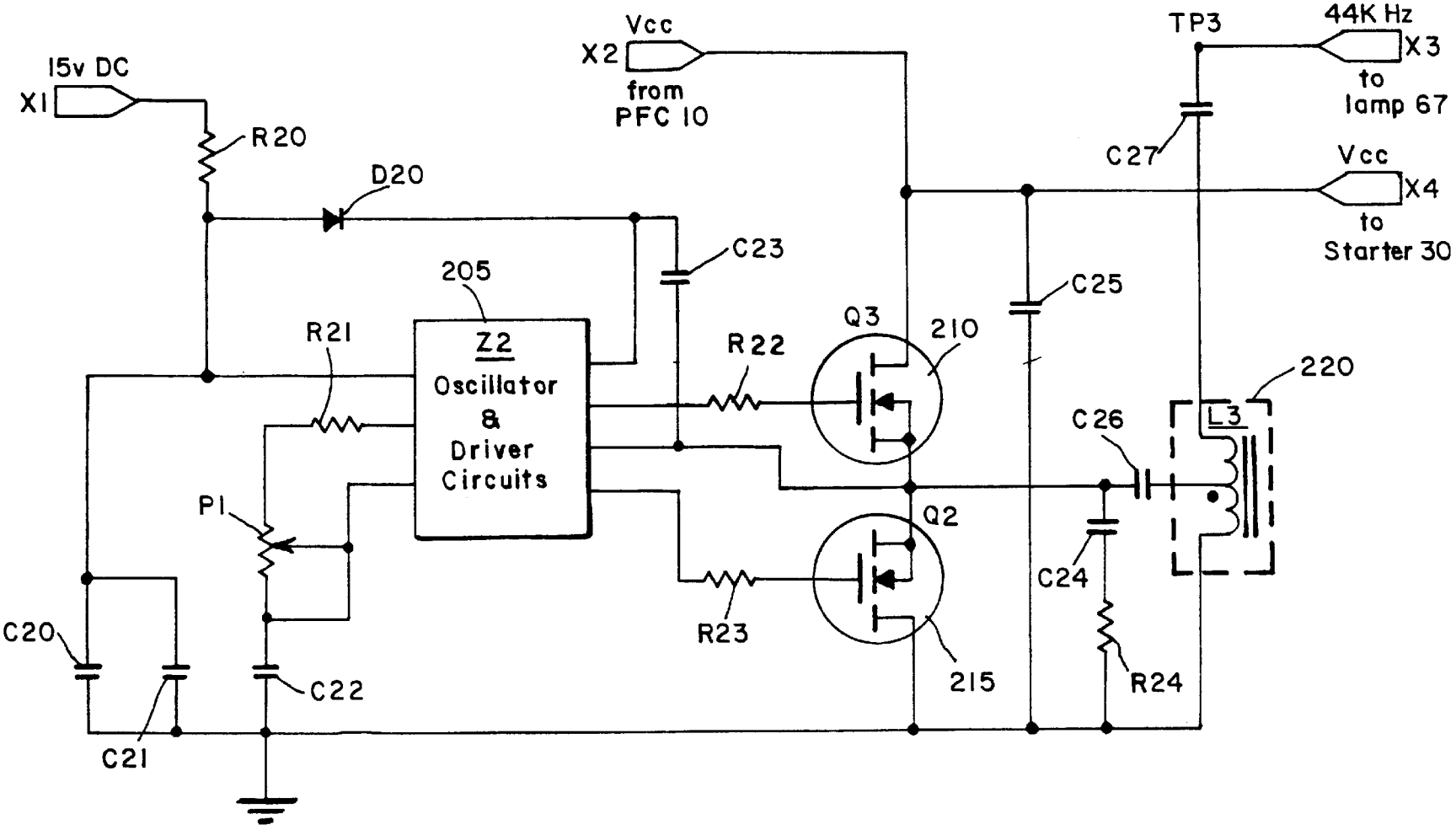
FIG. 3 is a simplified schematic of the DC-AC converter circuit forming part of the ballast circuit in FIG. 1.

The DC-AC converter circuit schematic is shown in simplified form in FIG. 3. The converter uses an IC Z2, 205 which contains an oscillator whose frequency is set by resistances R21, P1 and capacitor C22. Potentiometer P1 allows adjustment of the frequency to 44K Hz. The Z2 IC also contains a low side and high side driver to drive FETs Q2, 215 and Q3, 210. A floating supply for FET Q3 is formed by diode D20, capacitor C23 and a current pump circuit inside the Z2 IC, 205. FETs Q2, Q3 and choke L3, 220 form a conventional half bridge circuit. A square wave is formed across the L3 coils by FETs Q2 and Q3 turning on alternately. A bypass capacitor C26 is provided to allow only AC current to be drawn by L3. Capacitor C24 and resistor R24 form a snubber circuit to reduce switching losses, while capacitor C25 is placed across the Vcc DC output to provide a high frequency low impedance to the starter circuit 30 at terminal X4.

Similarly, capacitors C20 and C21 are connected to resistor R20 to provide impedance for the approximately 12 VDC formed by dropping resistor R20 and a Z2 IC internal Zener diode.

Resistors R22 and R23 provide impedance in the drive circuits to FETs Q2 and Q3, to eliminate any high frequency oscillation that might be present from Z2.

Lamp operating current is supplied by choke L3, 220 through capacitor C27 which supplies a ballasting impedance. The lamp operating current is at a frequency of 44 KHz and is supplied to the lamp 67 through the X3 terminal. FIG. 6, TP3 illustrates the lamp current waveform at test point TP3.

Figure 4:
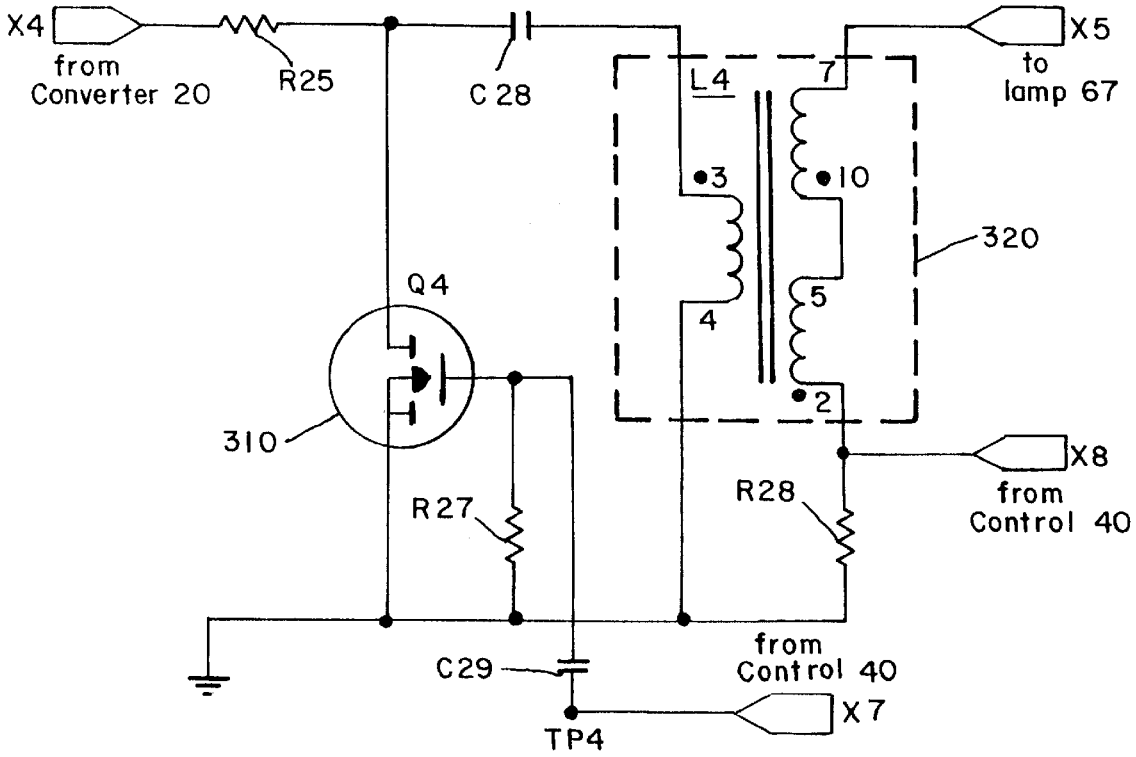
FIG. 4 is a simplified schematic of the starter circuit forming part of the ballast circuit in FIG. 1.

Refer now to FIG. 4 which is a simplified schematic of the starter circuit 30. A metal halide lamp requires a short 6000 volt pulse for starting which is provided by transformer L4, 320. L4 is driven by a capacitive discharge circuit formed by resistor R25, capacitor C28 and transistor Q4. Resistor R25 charges capacitor C28 through pin 3 and 4 of L4 to ground from the Vcc input at terminal X4. Because of the turns ratio of winding pins 3–4 to output winding pins 7–2 of L4, a 6000 V pulse is applied to the lamp through terminal X5. Terminal X7 is the drive point for transistor Q4, 310 and is a low frequency pulse at about 5 pulses per second from the control circuit 40. Capacitor C29 and resistor R27 provide impedance for the Q4 drive signal which is illustrated in FIG. 6, TP4, showing the waveform at test point TP4.

A resistor R28 is placed in series with the output winding of transformer L4 to sense the lamp current. This current is fed to the control circuit through terminal X8, and is used by the control circuit to command shut-off of starting, and to shut the ballast circuit down if the current is too high, as may be caused by a shorted or damaged lamp condition.

Figure 5:
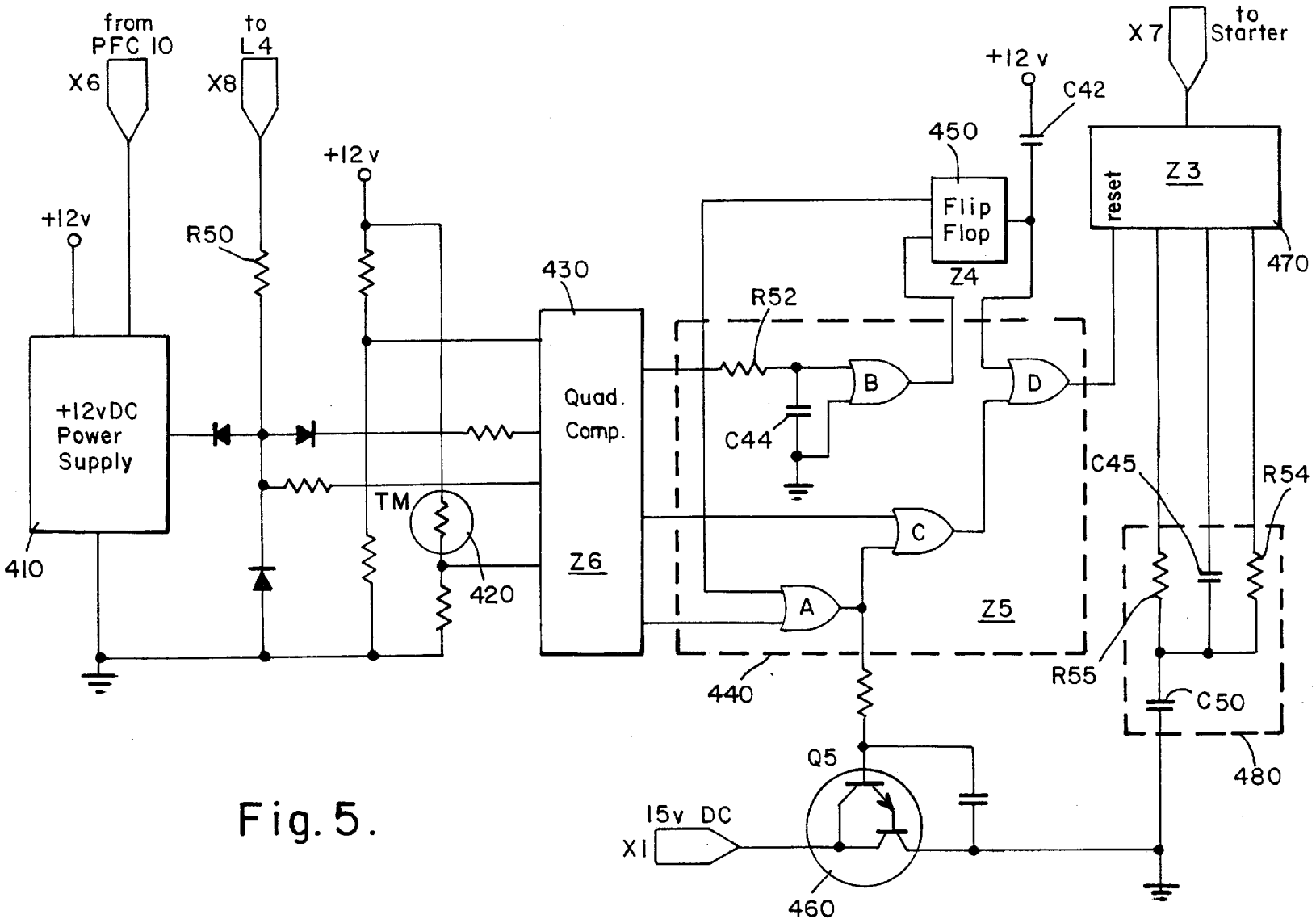
FIG. 5 is a simplified schematic of the control circuit forming part of the ballast circuit in FIG. 1.

The control circuit 40 interfaces with each of the above described circuits and is shown in a simplified, block diagram/schematic in FIG. 5. The circuit operates from a +12 VDC power supply 410 which is connected to the PFC circuit 10 DC output through terminal X6. Control input signals are fed into a comparator/gates circuit comprising quad comparator Z6, 430 and logic gates Z5A,B,C and D, which sense when the lamp current is high enough to shut off the starter pulse. The lamp current signal from the starter circuit is fed through terminal X8, through dropping resistor R50 into the quad comparator Z6. When the operating lamp current is sensed as being an over current, the comparator/gates shut off the ballast circuit by turning on transistor Q5. This action shorts the supply to PFC IC Z1 in the PFC circuit at X1, causing Z1 to stop. IC Z4, 450 is a flip-flop that latches if an over-current is sensed. Resistor R52 and capacitor C44 form a 680 msec time delay for shut down. A thermistor TM 420 provides a ballast temperature sense signal to Z6 to initiate shut down if necessary. Capacitor C42 and a resistor in the flip-flop 450 form a delay time of approximately 1 second, so that Z3 starting pulses are not generated until the 12 VDC is up and stable.

IC Z3, 470 is a 14 stage ripple-carry binary counter/divider and oscillator which is used to generate clock pulses for the starter circuit 30 through terminal X7. A frequency-set circuit 480 comprising capacitor C45, resistor R54 and resistor R55 in parallel, and capacitor C50 connected in series, sets the oscillating frequency for Z3. The Z3 output signal is taken from the first bit of the ripple counter, which is a square wave of 5 Hz. Counting is stopped by a reset signal from Z6 and Z5 gate D if the lamp is turned on and drawing current or an over temperature condition exists.

The result of the above design of an electronic ballast circuit is that the ballast is efficient, having power losses of 20 percent or less. Since the required lamp wattage is relatively small, eg., 39 W, the ballast heat dissipation will also be small. The circuit components are small and light weight, permitting most of them to be mounted on a printed wiring board, sized to fit in a small sized module. Major heat dissipating components such as chokes and transformers are heat-sinked to the containing module.

From the foregoing description, it is believed that the preferred embodiment achieves the objects of the present invention. Various modifications and changes may be made in the circuit described above which are apparent to those skilled in the art. These alternatives and modifications are considered to be within the scope of the appended claims and are embraced thereby.

Having described the invention, what is claimed is:

1. An electronic ballast circuit for energizing a high intensity discharge lamp at high frequency, said ballast circuit, in combination comprising:

(a) an input power connector;

(b) a protection fuse which is connected to said input power connector;

(c) a power conditioning circuit which is connected to said input power connector and to said fuse, said power conditioning circuit comprising; means for circuit surge protection from high transient input voltage signals, a full-wave bridge rectifier circuit which is connected to said means for circuit surge protection, said rectifier circuit having a ripple waveform high voltage DC output, an input filter means for smoothing said high voltage DC output, means for input power factor correction, and an output filter means for harmonic correction;

said power conditioning circuit including a conductor that connects to said high voltage DC output for use by a control circuit;

said means for input power factor correction acting to produce a near unity input power factor, thereby reducing ballast power losses to the minimum when using utility AC input power;

said power conditioning circuit producing a conditioned 350 VDC or 450 VDC output voltage at its output terminals, commensurate with a 120 VAC or 277 VAC input voltage applied to said input power connector;

(d) a DC-AC converter circuit, said converter circuit comprising a half-bridge circuit, driver means for driving transistor switches in said half-bridge circuit, an oscillator means supplying high frequency signals to said driving means, and a frequency adjustment circuit that permits adjustment of the output of said oscillator means to 44 KHz; said converter circuit including a high voltage DC output for connection to a starter circuit;

said converter circuit accepting the DC voltage from said output terminals of said power conditioning circuit, and producing a high voltage AC, 44 KHz frequency signal for supply to said high intensity discharge lamp;

(e) a control circuit comprising a +12 VDC power supply, a comparator and logic gate array, a thermistor for sensing the temperature at a critical component of said ballast circuit and connecting a temperature signal input to said comparator and logic gate array, a 14 stage, ripple-carry binary counter/divider and oscillator circuit which is connected to an output of said comparator and logic gate array, and produces a 5 Hz square wave clock signal for use by a starter circuit, a flip-flop that latches if a lamp over-current is sensed, and transmits a stop signal to the reset of said counter/divider and oscillator circuit, said comparator and logic gate array also transmitting a stop signal to the reset of said counter/divider and oscillator circuit if said lamp is turned on and drawing current or an over-temperature condition is sensed, a frequency-set circuit which sets the frequency for said oscillator in said counter/ divider and oscillator circuit, and a first transistor switch for shutting down said ballast circuit if an over-current or over-temperature condition is sensed, said first transistor having its base connected to an output terminal of said and comparator and logic gate array and when turned on, connecting a ground to the supplies of said means for input power correction, said oscillator means and said driver means, shorting out the supplies and shutting down said ballast circuit;

(f) a starter circuit for starting up said lamp, said starter circuit receiving DC power from said DC-AC converter circuit and responsive to signal input from said control circuit, supplying a short 6000 volt minimum amplitude pulse to said lamp; and (g) an output power connector for connection to said lamp, said output power connector being connected to the 44 KHz AC output terminal of said DC-AC converter and to the 6000 volt pulse output terminal of said starter circuit.

2. An electronic ballast circuit according to claim 1, wherein said starter circuit comprises a capacitive discharge circuit whose input is connected to the high DC voltage output from said DC-AC converter, a transformer having a high ratio of secondary winding turns to primary winding turns, and which is connected to said capacitive discharge circuit, and a first resistor for sensing lamp current and connected to said transformer; said capacitive discharge circuit comprising a second resistor, a capacitor and a third transistor switch, said second resistor charging said capacitor through the primary winding of said transformer to ground, said third transistor switch being turned on by a signal from said control circuit and discharging said capacitor, forming a high voltage pulse of at least 6,000 volts peak at the transformer secondary winding due to the high turns ratio, and transmitting said high voltage pulse to said output power connector; said first resistor, in series connection with said secondary winding, sensing the lamp starting current and transmitting a signal to said control circuit for initiation of starting current turn-off.

* * * * *